United States Patent [19]

Unverferth

[11] 4,056,461

[45] Nov. 1, 1977

[54] RETORTING PROCESS UTILIZING A FLEXIBLE, HELICAL SHAPED CONVEYOR

[75] Inventor: Jack W. Unverferth, Walnut Creek, Calif.

[73] Assignee: Chevron Research Company, San Francisco, Calif.

[21] Appl. No.: 700,378

[22] Filed: June 25, 1976

[51] Int. Cl.[2] ..... C10G 1/02; C10B 49/16

[52] U.S. Cl. ..... 208/11 R; 208/8; 201/12; 202/117

[58] Field of Search ..... 208/8, 11 R; 201/4, 201/8, 12; 202/117, 118

[56] References Cited

U.S. PATENT DOCUMENTS

| | | | |
|---|---|---|---|
| 3,140,240 | 7/1964 | Fowler | 208/8 |
| 3,350,280 | 10/1967 | West | 208/11 R |
| 3,442,789 | 5/1969 | Zimmerman | 208/11 R |
| 3,655,518 | 4/1972 | Schmalfeld et al. | 208/11 R |
| 3,658,654 | 4/1972 | Gutberlet | 208/11 R |

FOREIGN PATENT DOCUMENTS

| | | | |
|---|---|---|---|
| 536,190 | 10/1931 | Germany | 202/22 |

*Primary Examiner*—Delbert E. Gantz
*Assistant Examiner*—James W. Hellwege
*Attorney, Agent, or Firm*—D. A. Newell; R. H. Davies; J. J. De Young

[57] ABSTRACT

Disclosed is a process for the retorting of shale and other similar hydrocarbon-containing solids in which the solids to be retorted are mixed with a hot solid heat transfer material to rapidly heat the hydrocarbon-containing solids to a high temperature and conveyed through the retorting vessel by means of a flexible, generically helical shaped, elongated, hollow longitudinal core element. The shale and heat transfer material are conveyed concurrently through a first section of a cylindrical vessel while a stripping gas is introduced into a latter section of the vessel and flows countercurrent to the movement of the two solids. The stripping gas along with entrained fines, gaseous hydrocarbons, and liquid hydrocarbons in the form of a mist are removed from a middle section of the vessel while the retorted shale is removed from the end of the vessel.

10 Claims, 3 Drawing Figures

RETORTING PROCESS UTILIZING A FLEXIBLE, HELICAL SHAPED CONVEYOR

BACKGROUND OF THE INVENTION

This invention relates to the retorting of hydrocarbon-containing solids, particularly shale.

Shale oil is not a naturally occurring product, but is formed by the pyrolysis or distillation of organic matter, commonly called kerogen, formed in certain shale-like rock. The organic material has limited solubility in ordinary solvents and therefore cannot be recovered by extraction. Upon strong heating, the organic material decomposes into a gas and liquid. Residual carbonaceous material typically remains on the retorted shale.

In its basic aspects, the retorting of shale oil and also other similar solid hydrocarbon-containing solids is a simple operation. The major step involves the heating of the solid material to the proper temperature and the recovery of the vapor evolved. However, for a commercially feasible process it is necessary to consider and properly choose one of the many possible methods of physically moving the solid material through a vessel in which the retorting is to be carried out as well as the many other variances in operating parameters, all of which are interrelated. The choice of a particular method of moving the solids through the vessel must include a consideration of mechanical aspects as well as the chemistry and the processes involved. Further, it is necessary to consider the many possible sources of heat that may be used for the pyrolysis or destructive distillation.

In order to achieve a retorting process that is economically attractive and one which produces the maximum amount of high-quality shale oil, the various operating parameters must be controlled so that the overall process is economical, continuous and highly reliable. Any equipment usable in the process must permit a high throughput of material since enormous quantities of the shale must be processed for a relatively small recovery of shale oil. Process equipment for shale must have a high thermal efficiency and as in the case of all mechanical devices, the retorting equipment should be as simple as possible so that relatively proven and economically attractive mechanical devices may be utilized in the operation of the retort.

In an effort to provide an economically commercial process literally hundreds of retorting processes have been proposed, each of which offers a somewhat different choice and/or combination of the many possible operating conditions and apparatus.

One problem with many prior art processes is that the quality of shale oil obtained is relatively low. In many shale retorting processes, large quantities of shale fines produced in crushing the shale and fines produced during the retorting process find their way into the condensed shale oil. These fines lead to costly and difficult separation problems. Also, a second common problem with many prior art processes is that the high temperatures required to volatilize and distill off the shale oil also lead to many secondary and frequently undesirable side reactions which may increase the production of the normally gaseous products and decrease the yield and quality of the condensable products. Another problem with many prior art retorting processes is that the retorting takes place in the presence of molecular oxygen which leads to decreased yields and an inferior product.

The quality and yield of shale oil produced is greatly dependent upon how the retorting process is operated. For example, the raw shale can be heated rapidly or slowly and the shale can be finely divided or be in widely varying sizes. These and many other factors greatly influence the quantity and quality of the shale oil produced and the overall thermal efficiency of the process. In essentially all processes for the retorting of shale, the shale is first crushed to reduce the size and time necessary for the retorting process. During the crushing or mining of the shale it is difficult to obtain uniformly sized pieces and/or costly to separate the crushed shale into various sizes. It is therefore desirable to have a retorting process which can accommodate a wide size range of solids.

Cylindrical-shaped retorts with helical or screw-shaped-type conveyors are known in the art as shown, for example, in U.S. Pat. Nos. 759,988; 1,388,718; 1,475,901 and 2,934,476. Screw-type conveyors or mixers are highly efficient for moving and mixing solids, but these patents teach processes wherein the retort is externally heated.

The use of direct contact solid heat transfer materials is also known in the art as shown, for example, in U.S. Pat. No. 2,788,314.

The use of stripping gases flowing in countercurrent flow relative to the movement of the solid being retorted is also known in the art as shown, for example, in U.S. Pat. Nos. 2,664,389 and 2,934,476. However, these countercurrent flow processes involve passing the stripping gas through the entire length of the retort and involve the condensation of hydrocarbons in the retort.

Many of the foregoing problems are solved by the process of the present invention which is designed to produce the maximum amount of condensable hydrocarbons with a minimum of gas yield and a minimum of volatile matter being left in the retorted solid.

SUMMARY OF THE INVENTION

A continuous process for retorting hydrocarbon-containing solids which comprises:

a. introducing a solid heat-transfer material at an elevated temperature and hydrocarbon-containing solids into a first section of a stationary, elongated vessel;

b. conveying said heat-transfer material and said hydrocarbon-containing solids through said vessel by means of a rotating conveyor whereby said hydrocarbon-containing solids and said heat-transfer material are intermixed and said hydrocarbon-containing solids are heated to an elevated retorting temperature in said first section of said vessel;

c. introducing a stripping gas at an elevated temperature into a third end section of said vessel and passing said stripping gas through said third section of said vessel in countercurrent flow relative to the flow of said hydrocarbon-containing solids;

d. withdrawing at an elevated temperature an effluent stream from a second middle section of said vessel, said effluent stream comprising said stripping gas, entrained liquid and gaseous hydrocarbons and finely divided solids;

e. withdrawing at an elevated temperature retorted solids and said heat-transfer material from said third section of said vessel;

f. separating the condensable hydrocarbons from said effluent stream.

DETAILED DESCRIPTION OF THE INVENTION AND PREFERRED EMBODIMENTS

An object of the present invention is to provide an economic process for the retorting of shale so as to provide the maximum yield of condensable hydrocarbons combined with the minimum production of noncondensable gaseous products.

A further object of the invention is to produce a retorted shale containing the minimum amount of residual volatilizable hydrocarbons.

Another object of the invention is to provide a continuous retorting process which has a high thermal efficiency along with a high throughput of solids.

Another object of the present invention is to provide a retorting process which can accommodate a wide size range of solids.

A further object of the present invention is to provide a process for the retorting of solids in which there is a minimum production of fines in the retorting vessel.

The process of the present invention will generally be described with reference to the processing of shale. However, the process of the present invention can also be used to retort other hydrocarbon-containing solids as defined herein.

The term "hydrocarbon-containing solid" as used herein is intended to include oil shales, oil sands, coal, tar sands, gilsonite, mixtures of two or more of the materials or any of other hydrocarbon-containing solids with inert materials, etc.

As used in the present specification, the term "oil shale" is intended to mean inorganic material which is predominantly clay, shale, or sandstone in conjunction with organic materials composed of carbon, hydrogen, sulfur, oxygen and nitrogen, called kerogen.

The term "retorted solids" is used in the present aplication to mean hydrocarbon-containing solids from which essentially all of the volatilizable hydrocarbons have been removed, but which may still contain residual carbon.

The term "spent solids" is used in the present application to mean retorted solids from which essentially all of the combustible residual carbon has been removed.

The terms "condensable", "noncondensable", "normally gaseous", or "normally liquid" is relative to the condition of the material at 77° F (25° C) and one atmosphere.

Figure 1:
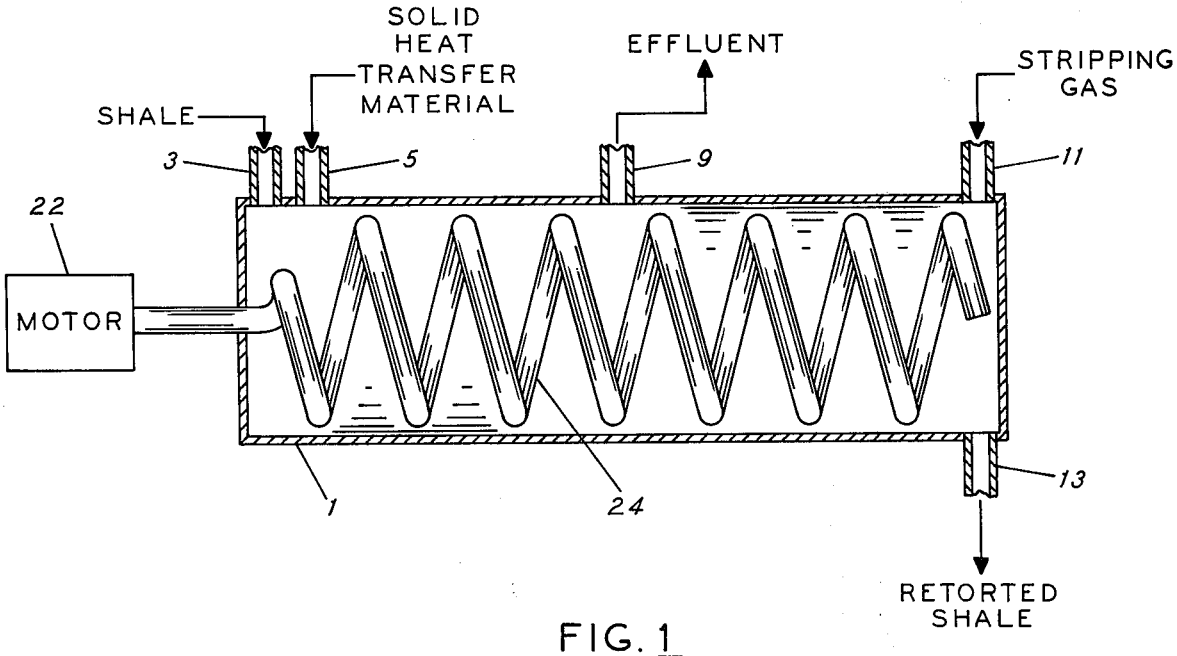
FIG. 1 is a schematic flow diagram illustrating the flow of gas, liquids and solids through the retorting vessel.
Figure 2:
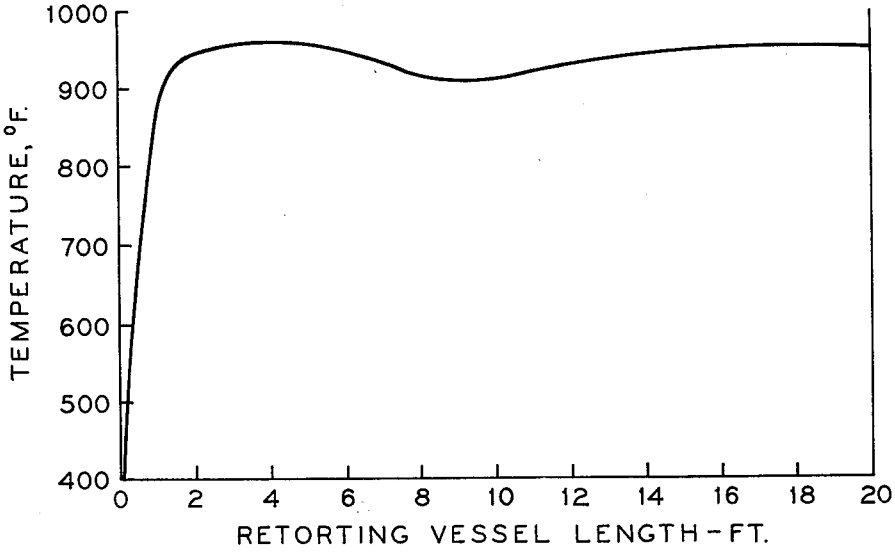
FIG. 2 is a diagramatic representation of a typical temperature profile in the retorting vessel.

The process of the present invention is best understood by reference to the accompanying figures. Referring now to FIGS. 1 and 2:

In FIG. 1 shale or some other hydrocarbon-containing solid is introduced into an elongated, hollow, cylindrical-shaped vessel 1 via line 3 while a solid heat transfer material is introduced via line 5. The size of the shale introduced into the vessel can vary greatly from the size of shale fines about 0.001 to 0.1 inch in diameter to large pieces of shale 3 inches in diameter. Larger pieces can also be retorted in the process. One particular advantage of the process of the present invention is that it can accommodate a wide size range of crushed shale as distinguished from many prior art processes in which the shale is crushed and/or separated into a relatively uniform narrow range of sizes.

In the present process it is preferred not to screen out the fines from the crushed shale. Generally the feed will contain 1 to 10 weight percent fines in the range 0.001 to 0.1 inch in diameter and more commonly 0.001 to 0.01 inch in diameter. The solid heat transfer material can also vary greatly in size and can be composed of numerous substances, for example, sand, steel or ceramic materials. Preferably, the heat-transfer material comprises spent shale which has been heated to an elevated temperature by combustion of residual carbon remaining on the shale from the retorting step.

The shale can be introduced over a wide range of temperatures, but preferably the shale is introduced at a temperature slightly below (50° to 75° F) the retorting temperature of the shale. The term "retorting temperature" or "elevated retorting temperature" is used in the present invention to mean the temperature at which 10 weight percent or more of the volatile components in the hydrocarbon-containing solid are volatized. Typically, the shale will be introduced at a temperature below 750° F and preferably from 50° to 700° F.

The heat-transfer material is introduced at an elevated temperature in the range of 1000° to 2000° F or higher, but preferably in the range 1200° to 1700° F, and more preferably 1300° to 1500° F. The quantity and temperature of the heat-transfer material introduced into the vessel can readily be adjusted to heat the raw shale to the desired retorting temperature.

A rotating mechanical conveyor 24 driven by motor 22 or other suitable means mixes the shale and the heat-transfer material and the raw shale is rapidly heated to a suitable retorting temperature from 800° to 1100° F and preferably 850° to 950° F. Higher or lower temperatures may be required with solids other than shale.

The vessel can be vertical or inclined, but preferably it is horizontal. The vessel contains rotary conveyor means for transporting the solids through the vessel and for mixing the shale and the solid heat-transfer material. The rotary conveyor can be rigid and auger-like in shape. Much more preferred, however, the rotary conveyor consists of an elongate, flexible helical-shaped element that looks much like a large coil spring. The helix, spiral, or spring-like conveyor is distinguished from an auger-like conveyor which has a rigid shaft with an attached spiral flange. The preferred helical-shaped conveyor has a hollow core, that is, no rigid central shaft.

It has been found that a flexible, helical conveyor provides many advantages over a rigid auger-like conveyor. More particularly, the rigid type conveyors tend to consume much larger amounts of energy in conveying the solids through a hot retort and also produces fines which tend to end up in the condensed oil. A rigid auger-like conveyor requires more energy for several reasons. First, the rigidness of the auger and the retorting vessel leads to the grinding and comminution of solids as they are transported through the retort. Secondly, as solids are retorted and simultaneously transported through the retort temporary plugging can occur. Since an auger-like conveyor is rigid, a substantial increase in torque is required in order to keep the materials moving.

The preferred flexible, helical conveyor of the present invention can expand, contract, or bend like a spring both radially and longitudinally. Thus, when there is increased resistance at some point in the vessel, the helix simultaneously compresses, expands and bends in response to the resistance, thus decreasing the grinding of the solids and the production of fines. As the temporary blockage or resistance to flow at some point in the retort decreases, the helix returns to its original shape. Thus, one can maintain a relatively constant torque on the helix which saves considerable energy and also at the same time reduces the production of fines in the retort.

The conveyor extends along the entire length of the retort which can be from a few feet in length to 20 or more feet in length. Preferably, the conveyor fits rather loosely in the vessel, such that the diameter of the helix may be, for example, only three-fourths of diameter of the vessel. The design of the conveyor and the retort can, of course, vary greatly depending on various factors. For example, the diameter of the retort and the conveyor need not be uniform along the entire length of the retort. Similarly, the coils of the conveyor can be designed with varying pitches to control the movement of solids in the retort. These and other parameters such as speed of rotation and the cross-sectional area occupied by the conveyor can readily be adjusted by one skilled in the art to obtain the desired residence time and degree of retorting. The conveyor is preferably designed such that the largest piece of shale introduced into the retort can pass through the retort without being broken into smaller pieces.

Another advantage of the present invention resides in the fact that a single conveying means and accompanying motor can be utilized to convey the widely varying sizes of solids through the retort while essentially all (98 weight percent or more) of the volatilizable hydrocarbons are removed from the solids by the time they reach the end of the retort.

An important feature of the present invention resides in the fact that the shale is rapidly heated to the desired retorting temperature. Generally, the rapid heating will occur in the first 10 percent of the total length of the vessel, but of course, this can be readily adjusted by varying many factors, including the temperature and quantity of heat-transfer material and the speed of rotation and design of the conveyor mechanism.

It has been found that if the shale is rapidly heated to a high temperature, a significant percentage of the volatile hydrocarbons will rapidly vaporize while the remaining portions of the volatile matter in the shale will come off at a much slower rate. The difference in the rate of volatilization is not fully understood, but it is believed that the variance in size of the crushed shale is the most significant factor. Normally, the larger the size of the rock, the longer the residence time that is required to remove a high percentage of the volatile hydrocarbons.

One advantage of the present invention resides in the fact that the volatilized hydrocarbons are quickly removed from the vessel thus minimizing undesirable secondary reactions, such as cracking or coking, which tend to produce larger quantities of less-desirable non-condensable gaseous hydrocarbons or polymerization products which create downstream refining problems.

Referring again to FIG. 1, the vaporized and pyrolyzed shale oil is removed via line 9, along with a stripping gas. The stripping gas is introduced via line 11 and flows countercurrent to the flow of the solids and provides the heat to maintain the solids at a relatively uniform elevated retorting temperature as the remaining volatilizable hydrocarbons in the shale are driven off. Retorted shale and the heat-transfer material are removed via line 13 for further processing.

The "first section" of the vessel as used herein is that portion of the vessel from the entry point of the hydrocarbon-containing solids to that point where the solids contact the stripping gas in the second section of the vessel. The "second section" of the vessel is that portion where the product effluent stream containing the stripping gas, entrained liquid and gaseous hydrocarbons and finely-divided solids is removed from the vessel. The "third section" of the vessel is that portion from where the retorted solids and heat-transfer material are removed from the vessel, including that portion where the stripping gas flows countercurrent to the flow of the solids, to the end of the second section as defined above. As is readily apparent, these sections may overlap to some degree, particularly when the product effluent stream is removed from more than one outlet.

As the shale and heat-transfer material pass through the first section of the retort there will be a slight decline in the temperature due to some cracking and other endothermic side reactions. As the solids pass through the third section of the retort, the heat of vaporization is supplied by the stripping gas introduced via line 11. The stripping gas is introduced at a rate sufficient to maintain the overall temperature in the retort at a relatively high and relatively uniform retorting temperature in the second and third sections of the retort. Typically, the stripping gas will be introduced at an elevated temperature in the range 800° to 1100° F, preferably 900° to 950° F and at a rate such that the linear velocity of the gas in the retort is in the range 0.1 to 10 feet/sec. Higher stripping gas velocities can be used but higher velocities tend to entrain more fines in the product effluent stream which is generally undesirable. Thus, after the initial rapid heating of the hydrocarbon-containing solids in the first section of the vessel, the solids are maintained at a substantially uniform retorting temperature for the entire time that the solids remain in the retort. Preferably, after the initial heating, the temperature of the solids in the retort does not vary by more than 100° F and preferably less than 50° F. Preferably, the solids are maintained within 50° F of the highest temperature attained by the solids in the first section and more preferably within 25° F. Therefore the retorted solids, heat transfer material and the substantially gaseous effluent stream are all removed from the vessel at an elevated temperature not substantially different than the introduction temperature of the stripping gas, i.e., typically in the range 800° to 1100° F and preferably 875° to 975° F. By maintaining a relatively high and uniform retorting temperature in the vessel, this substantially prevents the condensation of vaporized hydrocarbons in the retort which can lead to serious plugging problems and which tends to decrease the yield of light non-condensable hydrocarbons and correspondingly decrease the yield of condensable hydrocarbon products.

As discussed previously, in order to obtain the maximum amount of condensable shale oil, the shale must be subjected to a sufficiently high temperature for a sufficient length of time in order that essentially all (98 weight percent or more) of the volatilizable components in this shale are removed. The third section of the retort wherein the stripping gas is used as a source of heat provides several advantages. First, the third section may be as long as necessary to provide adequate residence time for essentially all of the volatilizable hydrocarbons to be removed from the shale. This means that a wide size range of solids can be processed in a single retorting vessel. Secondly, the stripping gas quickly transports the volatilized constituents out of the retort which reduces the formation of gaseous products caused by undesired secondary reactions, i.e., cracking. Generally, the total residence time for solids in the retort will range from about 30 seconds to 15 minutes. Preferably, the residence time of the solids in the first section of the retort is sufficiently long so that at least 50 percent and preferably at least 80 percent of the volatlizable components in the solids are removed. Residence time will, of course, vary greatly depending on all of the interrelated variables but particularly the size of the solids introduced.

A desired temperature profile for the shale as it passes through a 20 foot retort is shown in FIG. 2. The stripping gas and entrained product and removed about 10 feet from the end of the retort.

The stripping gas entrains a small amount of shale fines or other finely-divided solids introduced with the raw shale or formed in the retort. The amount of fines entrained will depend upon many factors such as the size of the fines, the velocity of the stripping gas and the speed of rotation of the conveyor. Generally, the entrained finely-divided solids will range from about 0.001 to 0.1 inch in diameter and more commonly in the range 0.001 to 0.01 inch in diameter. The major portion of the fines, however, pass out of the end of the retort along with the heat transfer material. A preferred method and apparatus for minimizing the particulates contained in the condensed hydrocarbon product is disclosed in my copending application, Ser. No. 700,260, entitled, "Apparatus and Process For Reducing Particulates In a Vaporous Stream Containing Condensable Hydrocarbons," the entire disclosure of which is incorporated herein by reference.

Figure 3:
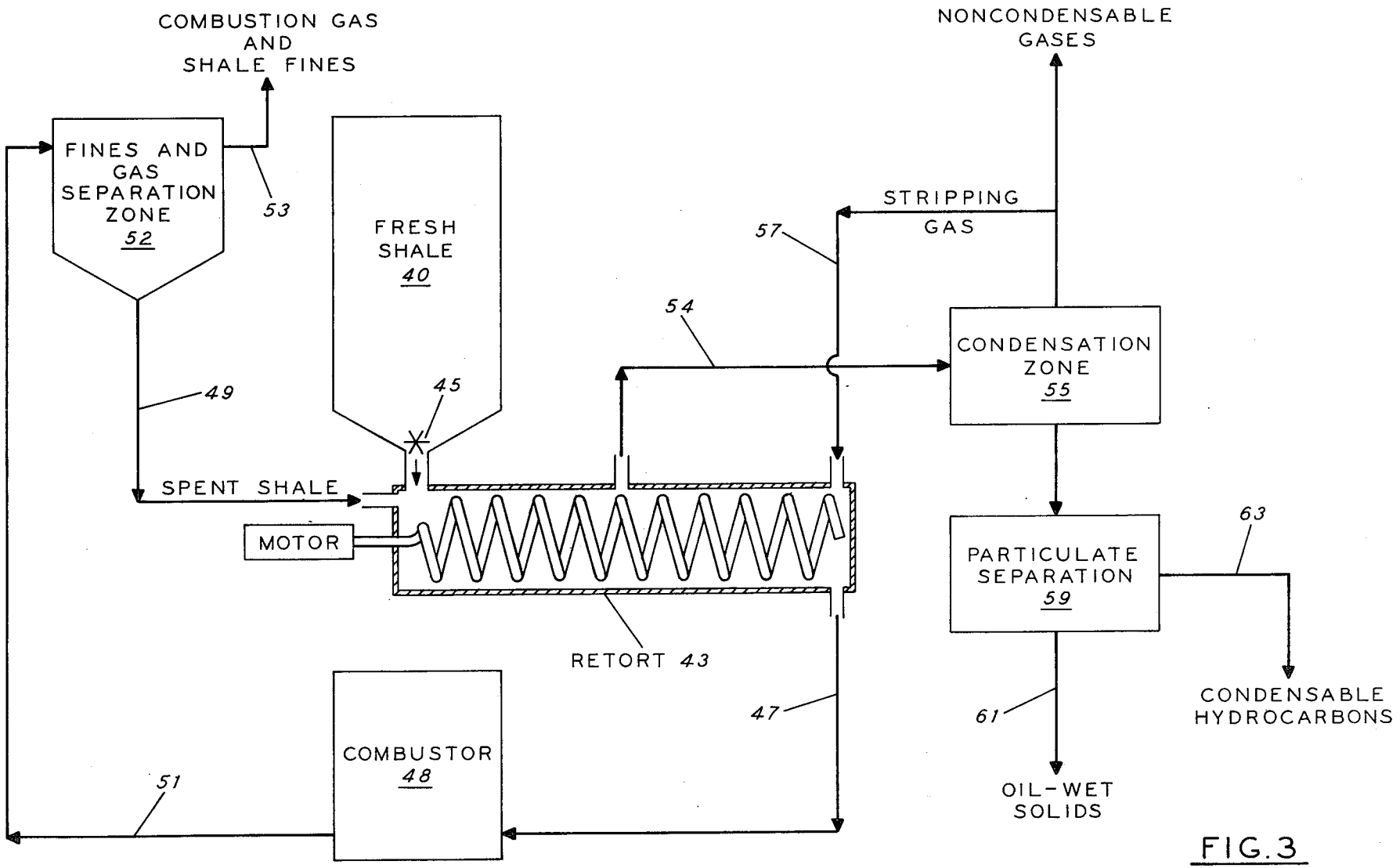
FIG. 3 is a schematic flow diagram of the retorting vessel along with auxiliary processing equipment.

Referring now to FIG. 3, which more particularly illustrates the overall process of the present invention including the integration of auxiliary processing equipment.

Fresh shale from storage hopper 40 is fed into the retort 43 by any suitable means, for example, star feeder 45. Preferably, the raw shale is fed into the retort at an elevated temperature slightly below the retorting temperature while the heat transfer material is fed into the retort via line 49 at an elevated temperature in the range 1200° to 1700° F. The raw fresh shale and the heat transfer material are rapidly mixed and are conveyed through the retort by helix 46 driven by a motor not shown. Preferably, the hot heat transfer material comprises spent shale. Typically, the ratio of the recycled solids to the fresh shale feed will be in the range of 1.5:1 to 6:1, while the recycled solids are heated to a temperature in the range 1200° to 1700° F. Preferably, the recycle ratio is maintained in the range 2:1 to 4:1. These factors are, of course, readily adjusted by any person skilled in the art to obtain the desired temperature in the retorting vessel.

Retorted shale is removed from the end of the retort via line 47 and passed to combustion zone 48. In combustion zone 48 the residual carbon remaining on the retorted shale is combusted forming spent shale at an elevated temperature. From combustion zone 48, the combusted products pass via line 51 to fines and gas separation zone 52. The shale fines and combustion gases are separated from the larger pieces of shale by conventional means, for example, a cyclone separator. The combustion gases, and shale not required for recycling to the retort, is removed via line 53 and preferably the sensible heat is recovered by conventional heat exchange means and utilized elsewhere in the process, particularly for preheating either the raw shale or the stripping gas. The remaining shale is recycled to the retort via line 49. Preferably, essentially no combustion takes place in the retorting vessel since this decreases the yield of hydrocarbons. Therefore, the retort is maintained essentially free of molecular oxygen, i.e., less than 1 volume per oxygen in retort.

The effluent stream is removed via line 54 from the retort. This effluent stream comprises the stripping gas, entrained liquid shale oil, which may be in the form of a mist, gaseous shale oil, and finely-divided shale fines. This stream is passed through condensation zone 55 wherein the condensable shale oil and solids are separated from the noncondenasable gases. A portion of the noncondensable gases is then heated to an elevated temperature and utilized as the stripping gas introduced via line 57 into the vessel. In general, the stripping gas will be essentially free of molecular oxygen (less than 1 volume percent) and will comprise hydrogen, light hydrocarbons having $C_1$–$C_4$ carbon atoms, $CO_2$ and $H_2S$. The $CO_2$ and $H_2S$ and any other contaminants can be removed by conventional means and the product light hydrocarbons can, of course, be used for other purposes. Hydrogen may also be present in the stripping gas and if desired, supplemental hydrogen can be added to the stripping gas.

After separation of the normally gaseous fraction, the condensable fraction containing shale fines is passed to particulate separation zone 59 wherein the solids are separated by conventional means as oil-wet solids. These solid fines entrained in the product stream contain a significant amount of unrecovered hydrocarbons. The separated oil-wet solids 61 are then mixed along with fresh shale to recover the oil. The condensable hydrocarbons are removed from the separation zone via line 63 for further refining if necessary.

The process of the present invention has a high overall mechanical and thermal efficiency for a combination of reasons. First, the raw shale enters the system at an ambient temperature while the spent shale leaves the system at a low temperature. Second, all of the heat for the process can be substantially supplied by the residual carbonaceous matter left on the retorted shale. Thirdly, the shale is moved through the entire retorting vessel by a highly efficient and simple mechanical conveyor which may be driven by a single prime mover.

The process furthermore produces very high yields of high quality synthetic shale oil for several reasons. First, by having a rapid direct heating of the shale followed by rapid removal of the vaporized components, excessive cracking and other undesired side reactions are avoided. Secondly, by forcing a stripping gas through the third section of the retort, the more slowly volatilized hydrocarbons are also quickly transported out of the retort. Thirdly, by maintaining a relatively uniform temperature in the retort, one can easily vary the residence time of the solid to vaporize and recover essentially all of the hydrocarbons in the shale, even though the shale may vary greatly in size. Fourthly, by having a relatively uniform high retorting temperature in the retort, condensation of hydrocarbons in the retort is substantially prevented. Also, recycle of the oil wet solids from the particulate separation zone further increases the yield of condensable hydrocarbons.

What is claimed is:

1. A continuous process for retorting hydrocarbon-containing solids which comprises:

a. introducing a solid heat-transfer material at an elevated temperature and hydrocarbon-containing solids into a first section of a stationary, elongated vessel;

b. conveying said heat-transfer material and said hydrocarbon-containing solids through said vessel by means of a flexible generally helical shaped, elongated, hollow longitudinal core, rotating conveyor disposed in said vessel throughout a substantial portion thereof, whereby said hydrocarbon-containing solids and said heat-transfer material are intermixed and sufficient heat is transferred from said solid heat-transfer material to said hydrocarbon-containing solid to raise the temperature of said hydrocarbon-containing solids to an elevated retorting temperature in said first section of said vessel;

c. introducing a stripping gas at an elevated temperature into a third end section of said vessel downstream from the location where said hydrocarbon-containing solids are introduced, and passing said stripping gas through said third section of said vessel in countercurrent flow relative to the flow of said hydrocarbon-containing solids;

d. withdrawing at an elevated temperature an effluent stream from a second middle section of said vessel, said effluent stream comprising said stripping gas, entrained liquid and gaseous hydrocarbons and finely-divided solids;

e. withdrawing at an elevated temperature retorted solids and said heat-transfer material from said third section of said vessel;

f. separating the condensable hydrocarbons from said effluent stream.

2. The process of claim 1 wherein said hydrocarbon-containing solids are heated to a temperature in the range 800° to 1100° F in said first section of said vessel and said solids are maintained in said second and third sections of said vessel at a temperature within 50° F of the highest temperature attained by said solids in said first section.

3. The process of claim 2 wherein said hydrocarbon-containing solids are heated to a temperature in the range 850° to 1000° F in said first section of said vessel and said solids are maintained in said second and third sections of said vessel at a temperature within 25° F of the highest temperature attained by said solids in said first section.

4. The process of claim 1 wherein said vessel is substantially horizontal.

5. The process of claim 1 wherein said hydrocarbon-containing solids comprise shale.

6. The process of claim 5 wherein said stripping gas comprises the normally gaseous components of shale oil.

7. The process of claim 1 wherein said hydrocarbon-containing solids are introduced into said vessel at a temperature from 50° to 700° F and said solid heat-transfer material is introduced into said vessel at a temperature from 1200° to 1700° F.

8. The process of claim 1 comprising the additional step of separating a normally gaseous stream from said effluent stream and recycling at an elevated temperature at least a portion of said normally gaseous stream to said vessel as said stripping gas.

9. The process of claim 1 wherein said vessel is maintained essentially free of molecular oxygen.

10. A continuous process for retorting shale which comprises:

a. introducing spent shale at an elevated temperature in the range 1200° to 1700° F and hydrocarbon-containing shale at a temperature in the range 50° to 750° F into a first section of a stationary, substantially horizontal, elongated, cylindrically-shaped vessel;

b. conveying said spent shale and hydrocarbon-containing shale through said vessel by means of a flexible, generally helical shaped, elongated, hollow longitudinal core rotating element whereby said spent shale and said hydrocarbon-containing shale are intermixed and sufficient heat is transferred from said spent shale to said hydrocarbon-containing shale to raise the temperature of said hydrocarbon-containing shale to a temperature in the range 875° to 975° F in said first section of said vessel;

c. introducing a stripping gas at an elevated temperature in the range 875° to 975° F into a third section of said vessel downstream from the location where said hydrocarbon-containing solids are introduced, and passing said stripping gas through said third section of said vessel in countercurrent flow relative to the flow of said spent shale and said hydrocarbon-containing shale whereby said hydrocarbon-containing shale is maintained at a temperature of at least 875° F in said third section;

d. withdrawing at an elevated temperature in the range 875° to 975° F an effluent stream from a second middle section of said vessel, said effluent stream comprising said stripping gas, entrained liquid and gaseous hydrocarbons and finely-divided solids;

e. separating the condensable hydrocarbons from said effluent stream;

f. withdrawing at an elevated temperature in the range 875° to 975° F retorted shale containing essentially no volatilizable hydrocarbons and said spent shale from said third section of said vessel;

g. passing said retorted shale and said spent shale into a combustion zone and combusting the residual carbon on said retorted shale forming spent shale at a temperature in the range 1200° to 1700° F;

h. introducing at least a portion of said spent shale from step (g) into said first section of said vessel.

* * * * *